US009498095B2

(12) United States Patent
Formon

(10) Patent No.: US 9,498,095 B2
(45) Date of Patent: Nov. 22, 2016

(54) GRAVITY FEED DISPENSER

(75) Inventor: John S. Formon, Oxford, PA (US)

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days.

(21) Appl. No.: 13/411,133

(22) Filed: Mar. 2, 2012

(65) Prior Publication Data

US 2013/0228587 A1 Sep. 5, 2013

(51) Int. Cl.
*A47K 10/42* (2006.01)

(52) U.S. Cl.
CPC ..... *A47K 10/424* (2013.01); *A47K 10/426* (2013.01)

(58) Field of Classification Search
USPC ..... 221/36, 41, 44, 45, 63, 303
See application file for complete search history.

(56) References Cited

U.S. PATENT DOCUMENTS

| | | | | |
|---|---|---|---|---|
| 340,355 | A * | 4/1886 | Ramser | 221/59 |
| 4,930,662 | A * | 6/1990 | Carrillo | 221/45 |
| 5,074,430 | A | 12/1991 | Roberts | |
| 5,100,038 | A | 3/1992 | Schafer | |
| 6,334,544 | B1 * | 1/2002 | Christensen et al. | 221/63 |
| 6,415,949 | B1 | 7/2002 | Tramontina | |
| 6,988,635 | B2 * | 1/2006 | Hochtritt et al. | 221/44 |
| 2003/0019880 | A1 * | 1/2003 | Timmers et al. | 221/47 |
| 2003/0111485 | A1 * | 6/2003 | Kohne et al. | 221/303 |
| 2011/0226799 | A1 * | 9/2011 | Watson et al. | 221/199 |

FOREIGN PATENT DOCUMENTS

| | | | |
|---|---|---|---|
| EP | 1238619 A2 | | 9/2002 |
| FR | 2538695 | * | 7/1984 |
| FR | 2936138 | | 3/2010 |
| WO | WO-01/82765 A1 | | 11/2001 |
| WO | 2005/034702 | | 4/2005 |

OTHER PUBLICATIONS

International Search Report and Written Opinion mailed May 15, 2013, issued in counterpart International application No. PCT/EP2013/053083 (11 pages).

* cited by examiner

*Primary Examiner* — Gene Crawford
*Assistant Examiner* — Kevin L Randall, Jr.
(74) *Attorney, Agent, or Firm* — Drinker Biddle & Reath LLP

(57) ABSTRACT

A gravity feed dispenser including a dispensing opening that exposes part of a front face and part of a bottom face of a stack of interfolded napkins. Interference tabs restrict the dispensing opening at the front face of the stack of napkins. A stack of interfolded napkins is seated on a bottom wall of the dispenser. The bottom wall is set back from a front wall in a front to rear direction to provide a dispensing gap. A leading flap of the stack of napkins hangs through the dispensing gap while a leading fold of the stack of napkins is pressed against a bottom end of the front wall. When the leading flap is pushed back, the leading fold passes beneath a bottom edge of the front wall to be grasped by a user for dispensing napkins at least two at a time.

8 Claims, 6 Drawing Sheets

GRAVITY FEED DISPENSER

FIELD OF THE INVENTION

The present invention is concerned with a gravity feed dispenser for containing a stack of interfolded sheet products such as napkins and the like and for dispensing the sheet products from a dispensing opening designed for dispensing more than one sheet product at a time.

BACKGROUND TO THE INVENTION

Gravity feed dispensers are known in the art, such as WO2005/034702 A1, U.S. Pat. No. 6,415,949 B1 and U.S. Pat. No. 6,334,544 B1. They are classified as gravity feed dispensers as they are designed so that, in use, the sheet products are delivered to the dispensing opening by force of gravity. This is distinct from other types of dispenser in which the sheet products are fed to the dispensing opening under the influence of a spring mechanism.

In WO 2005/034702 A1, a gravity feed napkin dispenser is disclosed comprising a main body portion supported on a stand. A cover closes a front of the main body portion and is openable to permit reloading of a stack of napkins in the main body portion. A first face plate is disclosed that has a dispensing opening designed for one at a time napkin dispensing. The dispensing opening of the first face plate is positioned to expose a bottom face of the stack of napkins. A user grasps a leading edge of the napkins through the dispensing opening in the stack for one at a time dispensing. A second face plate is also disclosed that exposes a front face of the stack of napkins so that one or more folds of the interfolded stack can be grasped in order to dispense two or more napkins at a time.

The second face plate is particularly useful in fast food restaurants having a drive-through window. An employee bags a customer's food order and adds one or more napkins to the bag. The appropriate number of napkins depends on the size of the order. The second face plate provides a dispensing opening that allows a user to count the folds of the napkins and take the appropriate number for bagging.

It has been found that employees may, particularly during busy periods, be tempted to grasp and bag more napkins than needed, which will increase an outlet's overheads. This is especially so because it is difficult to count the number of folds being grasped. The first face plate would offer a solution to the problem of taking too many napkins at a time by limiting the employees to one at a time dispensing, but this would slow down napkin dispensing, thus slowing throughput at the drive-through window.

It is one object of the present invention to provide greater restriction on the number of napkins per pull that are removed from the dispenser, while still allowing more than one at a time dispensing. It is a further objection of the present invention to enhance a user's ability to count the appropriate number of napkins for dispensing.

SUMMARY OF THE INVENTION

The present invention provides a gravity feed dispenser comprising a housing for containing a stack of sheet products, the stack comprising opposing top and bottom faces, opposing side faces and opposing front and rear faces, the top and bottom faces of the stack connected by the side faces and the front and rear faces, the housing comprising a bottom wall upon which a bottom face of the stack is to be seated, and a front wall for at least partly covering a front face of the stack, and a dispensing opening defined at least in part by the front wall, the dispensing opening for exposing a bottom part of the front face of the stack, at least one interference member restricting the dispensing opening by protruding into the dispensing opening in a downward direction, the direction being from a top of the stack to a bottom of the stack, and for interfering with a napkin dispensing path through the dispensing opening in a rear to front direction, the at least one interference member further for engaging the front face of the bottom part of the stack.

The at least one interference member makes it harder to remove a bunch of sheet products allowed by the full extent of the dispensing opening to encourage more frugal napkin dispensing, but not preventing removal of the full bunch if a particular order requires such. Further, the at least one interference member engages the front face of the stack, which has been found to provide a fanning effect at the bottom part of the napkins. This fanning effect makes it easier to discern and count the products in the bottom part of the stack, so as to promote removal of just the required number of products.

The dispenser may comprise first and second such interference members arranged on opposing sides of the dispensing opening, yet preferably inset from side edges of the dispensing opening.

These interference members have been found to engage the bottom part of the stack to cause a wave of more compressed parts of the front face of the stack at the interference members and a less compressed part of the front face of the stack between the interference members. The less compressed part is more central, which is where the user will grasp the products for dispensing. The less compressed part makes it easier to count and discern sheet products to promote dispensing of the correct number.

Alternatively, the dispenser may comprise more than two interference members. Such interference members may be arranged on opposing sides of the dispensing opening, so as to provide the aforementioned less compressed part at the front face of the stack between the opposing sets of interference members.

The at least one interference member may be provided in the form of a tab. The at least one interference member may extend partly or wholly across the dispensing opening in the downward direction. Even if the at least one interference member extends wholly across the opening in the downward direction, it extends only partly (usually a minor portion) across the dispensing opening in a side to side direction (with respect to the side faces of the stack).

The at least one interference member may protrude in the front to rear direction relative to the front wall to provide a distinct engagement point with the front face of the stack. This serves to enhance the stack fanning effect.

The front wall may comprise at least a thumb-sized or finger-sized notch or slot extending the dispensing opening for exposing further sheet products in a bottom of a front face of the stack. The notch or slot provides access to the further napkins with a user's thumb or finger. A user can thus count out yet further napkins and pull them through the dispensing opening and past the at least one interference member. The user may be required to compress the stack between thumb and forefinger to do so and will have to pull relatively forcefully. The notch or slot may be located in a central area with respect to opposing sides of the dispensing opening. The notch or slot is oriented in an upward direction relative to the dispensing opening. The notch or recess may be positioned centrally between the interference members arranged on opposing sides. In this way, the uncompressed part of the wave formed in the front face of the stack of napkins is accessible through the notch or slot.

In a second aspect of the present invention, there is provided a gravity feed dispenser having a housing defining and inside volume for containing a stack of interfolded sheet products, the housing comprising a bottom wall upon which a bottom face of a stack of interfolded sheet products is to be seated and a front wall having a bottom edge at least substantially in line with an inside surface of the bottom wall, wherein a front edge of the bottom wall is set back from an inside surface at a bottom of the front wall to define a dispensing opening therebetween.

The dispenser of the second aspect of the invention promotes two a time dispensing of the sheet products. The alignment of the bottom edge of the front wall and the inside surface of the bottom wall does not, perhaps counter-intuitively, prevent edge dispensing of the stack. Before the dispenser is ready for use, a leading panel (wherein adjacent panels of the sheet products are connected by a fold in the interfolded sheet product) may initially rest on the inside surface of the bottom wall. The panel extends from a front-facing leading fold. This leading panel can then be picked out of the opening, so that it hangs outside the opening from the fold.

In fact, when the leading panel is picked out of the dispensing opening, the leading fold is caused to curl up somewhat so as to be held against the inside surface of the front wall. This picking operation can be performed to get the stack started, and only needs be done once. To dispense the leading two napkins, the lead panel, which is hanging as a flap from the dispensing opening, is pushed rearwardly, away from the front wall, which forces the fold below the bottom edge of the front wall. This fold can then be pinched and withdrawn. Interfolded sheet products will have an adjacent sheet product pinched in the fold so that two sheet products are dispensed at one time. Removal of the two sheet products will leave a leading panel hanging as a flap from the dispensing opening, as a result of the stacks interfolded arrangement, for a repeat of the above dispensing process.

Alternatively, more than one fold can be pinched and withdrawn, so that a number of sheets equal to double the number of folds pinched can be ultimately withdrawn.

The front wall covers a bottom margin part of a front face of the stack, while the dispensing opening exposes a front margin part of a bottom face of the stack.

The front wall serves to block, mostly, dispensing of more than 2 sheet products, requiring a concerted effort to dislodge a plurality of folds beneath the bottom edge of the front wall. Dispensing of two napkins, however, is carried out easily by simply pushing the hanging flap back to pop the lead fold beneath the bottom edge of the front wall.

The bottom of the front wall and the inside surface of the bottom wall may be in alignment to within 5 mm or less, 4 mm or less, 3 mm or less, 2 mm or less or 1 mm or less. As the alignment increases, the blocking function is also increased and further the fold is more likely to be hidden behind the front wall until the hanging flap is pushed back.

Accordingly, perfect alignment is optimal for encouraging two at a time dispensing.

The dispenser may comprise at least one stack engagement member for engaging and gripping a bottom part of the stack to support weight of the stack. The stack engagement member frees, to some extent, the weight of the stack on the lead sheet product to allow the lead sheet product to be curled so that the fold engages the front wall and to allow the lead fold to be re-configured by pushing the lead flap to pass under the bottom edge of the front wall.

Alternatively, the stack engagement member may free up, to some extent, the weight on the leading fold and one to three folds adjacent the leading fold at the front face of the stack.

The stack engagement member may be arranged on the inside surface of the front wall for engaging a front face of the stack. The stack engagement member may protrude relative to the inside surface of the front wall. There may be provided first and second stack engagement members for compressing first and second portions of a bottom part of the front face of the stack at opposed side locations.

The at least one stack engagement member may extend to a position short of the bottom edge of the front wall to provide a space. Alternatively put or additionally, the stack engagement member may extend to a position short of the inside surface of the bottom wall. That is, a skirt portion of the front wall is provided that extends beyond a bottom of the at least one stack engagement member. The space or skirt portion frees a leading sheet product from engagement with the stack engagement member to allow it to be contorted as described above for dispensing sheet products two at a time.

Where the stack engagement member frees up the weight on more than just the leading fold, the space or skirt portion then frees the leading sheet plus one to three further adjacent folds at the front of the stack, such that four to eight sheet products can be dispensed at a time.

The space may be 5 mm or less from the bottom edge of the front wall, 4 mm or less, 3 mm or less and at least 1 or 2 mm. The space preferably is only big enough to accommodate the lead napkin fold so that the upper napkins are held away from the lead napkin by the stack engagement member to ease two at a time dispensing.

The front wall may comprise a thumb receiving notch or slot to extend the dispensing opening to expose napkins in the bottom part of the stack. The notch or slot allows a user to count napkins out and dispense more than two at a time if required by a particular order. These napkins will have to be dispensed more forcefully than the lead two napkins as the bottom bunch of napkins will have to be compressed and bent under the bottom edge of the front wall, thereby allowing, yet discouraging, dispensing of four or more napkins. The thumb notch or slot may be located centrally along the dispensing opening.

The front wall may comprise a major front wall part and a shield part attached to a bottom of the major front wall part and depending from the major front wall part. The shield part provides the bottom edge of the front wall. The shield part may be mounted by a suitable fastening mechanism allowing removal of the shield part relative to the major part. In this way, the dispenser can be configured between a two at a time dispenser with the shield in place on the major part, thereby closing a front portion of the dispensing opening, and a dispenser more freely allowing at least four sheet products to be dispensed at a time without the shield, since the front portion of the dispensing opening will then be open.

The shield part may be mounted by an adjustment mechanism allowing the bottom edge of the front wall to be moved between more and less aligned positions. This allows the freedom with which the leading napkins can be dispensed to be adjusted.

The shield part may comprise the thumb or finger receiving notch or slot described above.

In a third aspect of the present invention, there is provided a gravity feed dispenser comprising a housing for containing a stack of napkins, the housing comprising a bottom wall upon which a bottom face of the stack is to be seated and a front wall for at least partly covering a front face of the stack, the dispenser having a dispensing opening for exposing a bottom part of the front face of the stack, and at least one adjustable restriction member that is adjustable between positions in which the dispensing opening is more restricted and less restricted in a direction along the front wall toward the bottom wall.

The adjustable restriction member allows outlets to specify the dispenser according to their own sheet product usage criteria. The adjustable restriction member is moveable to ensure that dispensing of more than one fold at the bottom part of the stack is more or less difficult depending on the degree of restriction of the dispensing opening as defined by the position of the restriction member.

The adjustable restriction member may be attached to the front wall by a fastening mechanism allowing the position of the restriction member relative to the front wall to be adjusted.

The adjustable restriction member may be provided in the form of a shield attached to the front wall, the shield extending from one side of the dispensing opening to an opposed side of the dispensing opening. This type of restriction member has been found to be especially effective at blocking more than the defined amount of sheet products from being dispensed.

The adjustable restriction member may also be removable so as to completely open the dispensing opening. That is, the restriction member may be mounted to the front wall by a fastening mechanism that is suitable for allowing the restriction member to be removed from the front wall. In this way, not only can more and less restricted positions be provided, but also unrestricted positions can be provided.

The dispenser may include at least one stack engagement member protruding relative to a bottom edge of the front wall for engaging and gripping a bottom part of the front face of the stack. The restriction member may be mounted to the front wall via the stack engagement member. The stack engagement member provides a convenient mounting location. It may be mounted by at least one fastening mechanism associated with the restriction member and the stack engagement member that is configurable to allow the stack engagement member to move relative to the stack engagement member and the front wall to provide different dispensing opening restriction positions.

The restriction member extends beyond the stack engagement member to provide a skirt portion extending toward the bottom wall. The stack engagement member is able to free a leading sheet product or leading bunch of sheet products in line with the skirt portion from some of the weight of the stack so that the leading napkin(s) can be pulled under the skirt portion and dispensed more easily, while the stack engagement member and the restriction member serve to discourage excess sheet product dispensing.

The stack engagement member protrudes relative to an inside surface of the front wall so as to compress the front face of the stack.

The at least one stack engagement member may comprise first and second stack engagement members respectively disposed on opposed sides of the dispensing opening, yet inset from the side ends of the dispensing opening to provide suitable mounting locations for mounting the restriction member to the front wall via the first and second restriction members.

The dispenser of the aspects of the present invention may comprise further features as defined below.

The dispenser may include a rear wall opposed to the front wall and connected to the front wall by side walls. The rear wall may define a slide surface for supporting a rear face of the stack. The slide surface may be at least partly curved. The curve may be such that a bottom portion is less steeply inclined than a top portion.

The front wall may be part of an openable front cover to allow for the housing to be filled and refilled with a stack of sheet products.

The dispenser may include a stand for the housing to allow the housing to be stood on a horizontal surface such as a countertop. The stand may be removable to allow the housing to be mounted to a vertical surface.

The housing may include means allowing the housing to be mounted to a vertical surface such as a site wall.

The bottom wall may be provided as part of a face plate. The face plate may be removable to allow it to be exchanged with a face plate defining a different kind of dispensing opening.

The dispenser may comprise the stack of sheet products. The stack of sheet products may be a stack of napkins. The stack of napkins may be interfolded.

BRIEF DESCRIPTION OF THE FIGURES

FIGS. 6(*a*) and 6(*b*) also show a dispensing gap provided between a front edge of the bottom wall and an inside surface of the front wall at a bottom edge of the front wall.

DETAILED DESCRIPTION OF PREFERRED EMBODIMENTS OF THE INVENTION

Figure 1:
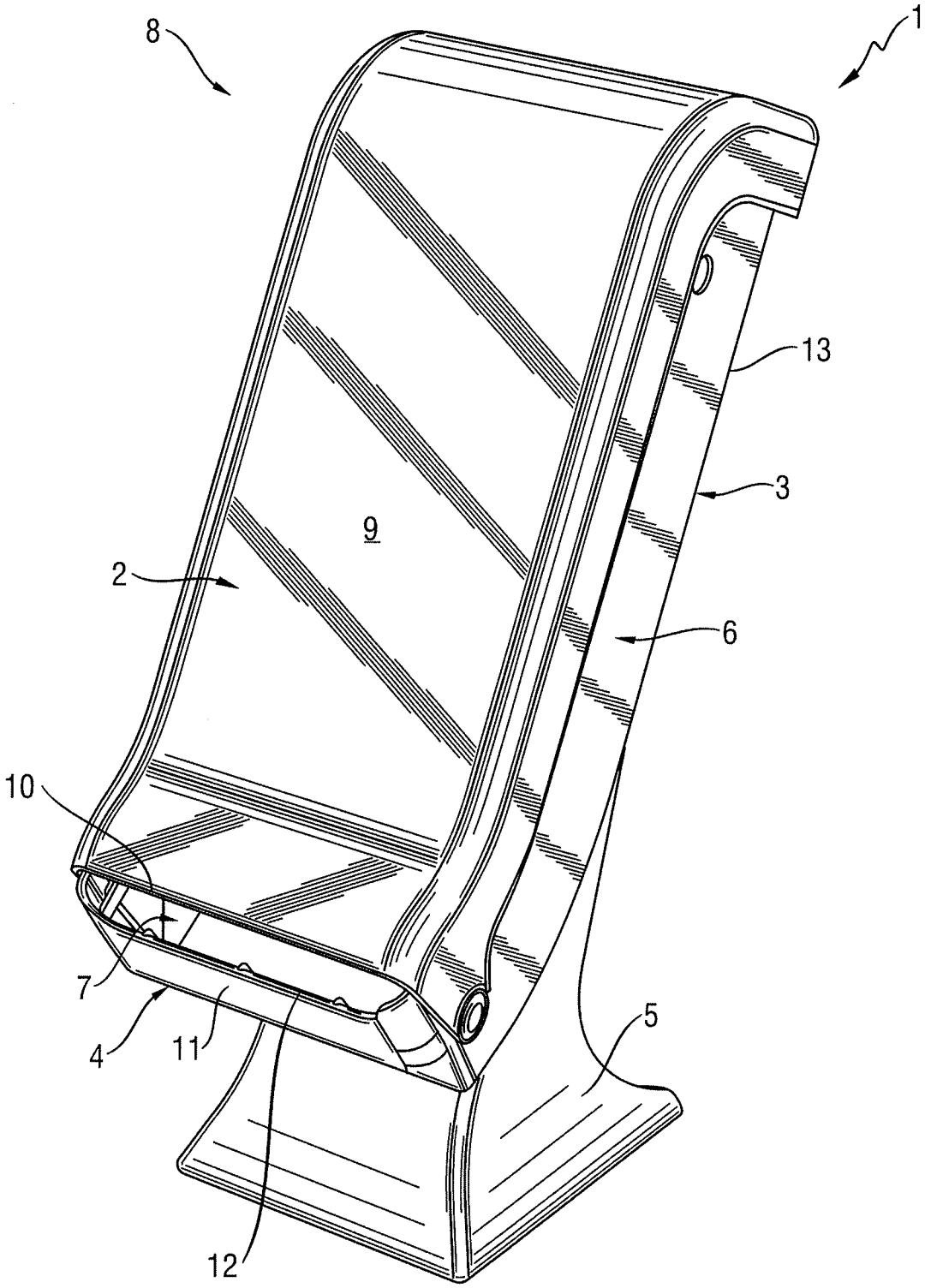
FIG. 1 shows a dispenser of a known kind to which modifications according to the present invention are to be applied. The dispenser is of a gravity feed kind having a front cover mounted to a rear housing part, which together define a housing for containing a stack of napkins. The front cover defines a front wall of the housing. A face plate is provided that is attached to the rear housing member and forms a bottom wall of the housing upon which the stack is to be seated. A bottom edge of the front wall and an inside surface of the bottom wall are spaced apart in order to define a dispensing opening exposing a bottom bunch of napkins in the stack. The present invention provides first and second embodiments for restricting the dispensing opening to encourage more economical napkin dispensing by limiting the number of napkins that can be freely withdrawn through the dispensing opening.

FIG. 1 shows a dispenser 1 of a gravity feed kind. The dispenser 1 comprises a rear housing part 3 and a front cover 2. A face plate 4 is removably attached to the rear housing part 3. The rear housing part 3, the front cover 2 and the face plate 4 together define a housing 8 for containing and protecting a stack of interfolded napkins. The front cover 2 provides a front wall 9 of the housing 8 having a bottom edge 10. The face plate 4 provides a bottom wall 11 of the housing 8 upon which the stack of napkins is to be seated. The bottom wall 11 of the housing 8 and the bottom edge 10 of the front wall 9 of the housing 8 are spaced apart to define a dispensing opening 7 therebetween, which exposes a front face of the stack of napkins including a plurality of folds at a bottom end of the interfolded napkin stack. The dispensing opening 7 also exposes part of a bottom face of the stack of napkins because the front edge 12 of the bottom wall 11 is set back from an inside surface at a bottom of the front wall 9.

The rear housing part 3 provides a rear wall 13 that is curved and forms a sliding inside surface for supporting the stack of napkins along the feed path toward the dispensing opening 7. The front cover 2 and the rear housing part 3 both define side wall parts that together form opposed side walls 6 connecting the front wall 9 and the rear wall 13.

Further, a stand 5 is provided upon which the housing 8 is removably mounted. The stand 5 may be placed on a countertop or other such horizontal surface so that napkins in the stack are gravity fed along the slide formed by the rear wall 13 to the dispensing opening 7. The housing 8 is also provided with means for fixing the housing 8 to a vertical wall when the stand 5 is removed so that an outer surface of the rear wall 13 is abutted against the vertical mounting wall.

As has been described earlier in the present disclosure, the dispensing opening 7 may be considered to allow dispensing of too many napkins for certain applications. That is, if the dispensing opening 7 is an inch high in a direction extending perpendicularly from an inside surface of a bottom wall 11, then 20 or so folds will be exposed in the front face of the napkin stack, corresponding to 40 or so napkins. This may encourage a user to take more napkins at a time than is necessary or appropriate. Accordingly, the present invention modifies the dispenser 1 of FIG. 1 so as to restrict the dispensing opening 7 to discourage such over-dispensing, as described below with respect to the first and second embodiments.

Figure 2:
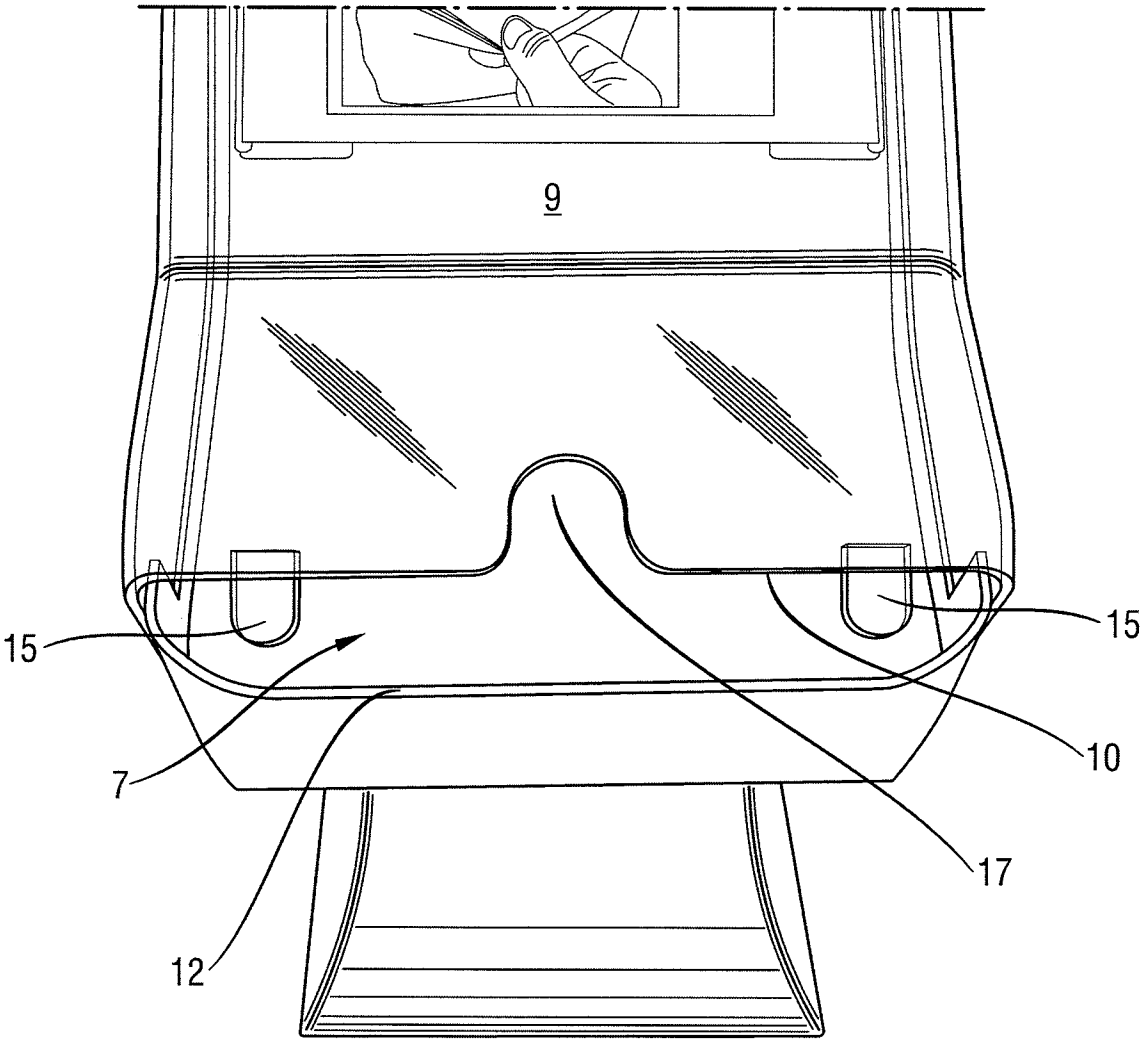
FIG. 2 shows a modification of the dispensing opening of FIG. 1 according to a first embodiment. There are shown first and second tabs protruding from a bottom edge of the front wall toward the bottom wall. The tabs provide interference with napkins dispensing through the dispensing opening to limit the number of napkins that can freely pass through the dispensing opening. Further, a notch is provided in a central region of the front wall and in communication with the dispensing opening to expose further napkins at the bottom of the stack so that a user can insert a thumb of finger to count a certain number of napkins for dispensing through the dispensing opening. The tabs also engage a front face of a bottom part of the stack by protruding inwardly relative to an inside surface of the front wall to thereby provide stack compression points.

FIG. 2 shows a first embodiment of the present invention in which the front wall 9 has been provided with first and second tabs 15 depending from the bottom edge 10 of the front wall 9 towards the bottom wall 11. The tabs 15 extend at least partially (preferably just partially) across the dispensing opening in a direction substantially normal to an inside surface of the bottom wall 11. The tabs 15 are provided for the purpose of interfering or blocking napkins from passing through the dispensing opening 7 in an upper part of the dispensing opening 7, and leaving a gap between a bottom of the tabs 15 and the bottom wall 11 to provide a lower portion of the dispensing opening 7 in which napkins are free to pass without interference from the tabs 15. The tabs 15 thus restrict an upper part of the dispensing opening and leave open a lower part of the dispensing opening 7.

The tabs 15 are provided on opposed sides of the dispensing opening 7 at positions inset from side ends of the dispensing opening 7. The front wall has a notch 17 cut into it extending from the bottom edge 10 of the front wall 9, which communicates with the dispensing opening 7. The notch 17 provides access to a thumb or finger of a user to further folds at the bottom end of the interfolded napkins stack.

The tabs 15 also protrude inwardly, as compared to an inside surface of the front wall 9, so as to provide compression points against a front face of the stack of napkins. The inside surfaces of the tabs 15 compress the stack, which causes a fanning effect at the notch 17, to allow a user to better count and discern individual napkins so as to promote an appropriate number of napkins being disposed at a time.

Figure 3:
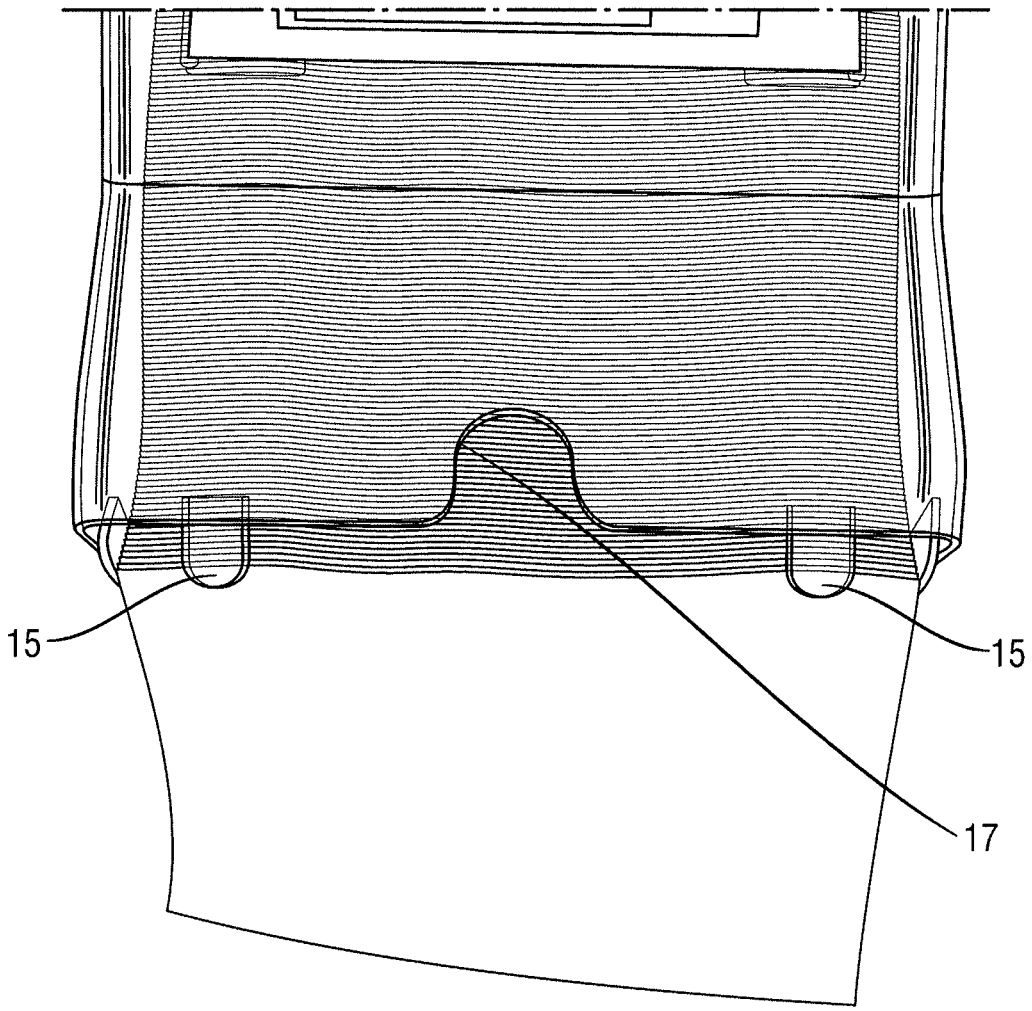
FIG. 3 shows the modified dispenser of FIG. 2 with a stack contained in the housing. As can be seen, the tabs compress the stack at opposed sides of the dispensing opening, to thereby fan out folds in the interfolded stack at a central location of the dispensing opening coincident with the notch.

FIG. 3 shows the modified dispenser of FIG. 2 with a stack of napkins loaded in the housing 8. The tabs 15 engage a front face of the stack of napkins causing compression of the stack at the locations of the tabs 15 on opposed sides of the stack of napkins. At a central location of the front face of the stack, the napkins are somewhat fanned or uncompressed at the location of the notch 17, which makes it easier for a user to count the number of napkins that is being grasped.

Further shown in FIG. 3 is that the tabs 15 tend to grip a bottom part of the stack, requiring a user to grasp the appropriate number of napkins and pull them under the tabs 15 in order to dispense them through the lower part of the dispensing opening 7 that is not blocked by the tabs 15. The tabs 15 thus require a more measured dispensing action and also block a large number of folds in the interfolded napkin stack from being freely dispensed and pulled out through the dispensing opening 7.

In use, a user will face the front of the dispenser 1, and grasp a desired number of napkins between forefinger and thumb at the notch 17. The user may count the number of folds, which will correspond to napkins in an amount double the number of folds counted. These napkins will then be pulled out through the dispenser opening so as to pass underneath the tabs 15.

The first embodiment of the present invention as shown in FIGS. 2 and 3 may be retrofitted to the existing dispenser of FIG. 1. More specifically, the tabs 15 may be separate pieces that are adhered to an inside surface of the wall 9. Further, the notch 17 may be cut out of the front wall 9. Alternatively, the dispenser 1 could be originally made in the shown form by molding the tabs 15 and the notch 17 integrally with the front wall 9 according to the form shown.

Figure 4:
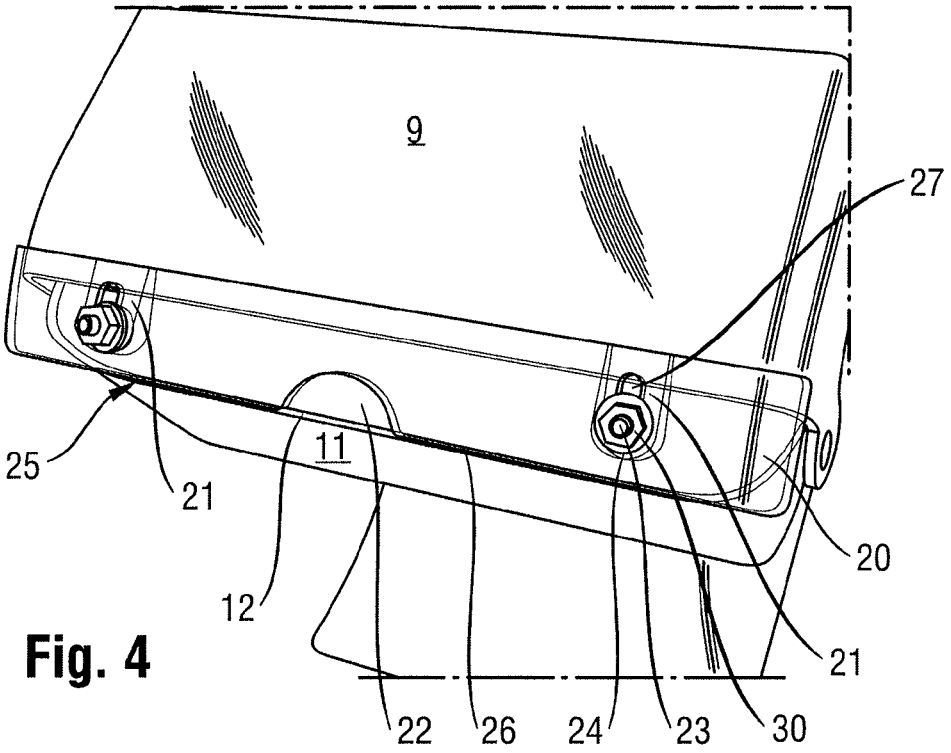
FIG. 4 shows a second embodiment of the present invention in which a modification to the dispensing opening of FIG. 1 is disclosed in FIG. 4, the dispensing opening is substantially closed by way of a shield member extending from one side of the stack dispensing opening to the other side of the dispensing opening. The shield member is attached to a bottom end of the front wall and extends from the bottom end of the front wall to a position in line with an inside surface of the bottom wall. A gap is provided between an inside surface of the shield at a bottom edge and a front edge of the bottom wall, to provide a dispensing gap. The dispensing opening is, relative to the dispenser of FIG. 1, entirely restricted in a direction extending along a front wall toward the bottom wall.

FIG. 4 shows an alternative modification of the dispenser 1 of FIG. 1 according to a second embodiment of the present invention. A shield 20 is mounted to a bottom of the front wall 9 so as to depend from the front wall 9 and extend so that a bottom edge 26 of the shield 20 is in alignment with a front edge 12 of the bottom wall 11. The front edge 12 of the bottom wall 11 remains set back from an inside surface of a bottom of the shield 20 so as to provide a dispensing gap 25 therebetween. The shield 20 thus substantially blocks the dispensing opening 7 in a rear to front direction or in a direction in which a user would pull napkins directly out from the dispensing opening 7, which is a direction normal to the rear wall 13. Intuitively, one would, perhaps, consider this to negate multiple napkin dispensing per pull, but, in fact, the dispensing process, to be described below with respect to FIGS. 5*a* to 5*c*, allows multiple napkin dispensing per pull in a more controlled, metered manner.

Figure 6A:
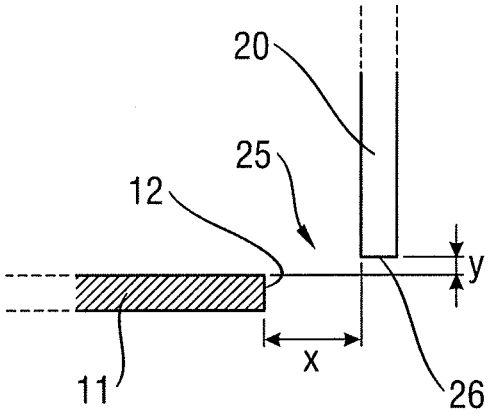
FIGS. 6(*a*) and 6(*b*) show the relationship between an inside surface of the bottom wall at a front edge and a bottom edge of the front wall according to the second embodiment, particularly the substantial vertical alignment therebetween.
Figure 6B:
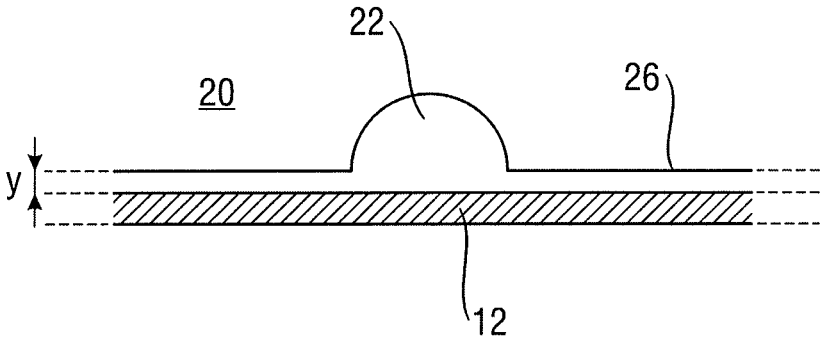

The relationship between the bottom edge of the shield and the front edge of the bottom wall is described further with respect to FIGS. 6(*a*) and 6(*b*), which are schematic figures. A bottom edge 26 of the shield 20 is aligned with an inside surface of the bottom wall 11 at a front edge 12 of the bottom wall 11, as shown by the dimension y. The dimension y is within plus or minus 5 mm (4 mm, 3 mm, 2 mm, 1 mm) of perfect alignment as described above. The dimension y represents vertical alignment and should be assessed when the bottom wall is viewed "edge-on", as shown in FIGS. 6(*a*) and 6(*b*). A dispensing gap 25 is provided between an inside surface of the shield 20 at a bottom edge 26 thereof and a front edge 12 of the bottom wall 11, as represented by the dimension x. The dimension x represents a horizontal gap and is to be assessed with respect to a cross-section passing through the shield 20 so that the thickness of the shield 20 is viewed "straight-on", as shown in FIG. 6(*a*). The dimension x may be at least 5 mm and up to 3 cm.

The shield 20 is mounted to the front wall 9 via bolts 23 passing through depending tabs 21. The tabs 21 are, in the present embodiment, substantially the same as tabs 15 shown in FIGS. 2 and 3, except for bolt receiving bores. Fastening means other than bolts 23 may be used. The tabs 21, as described above, engage a front face of a bottom part of the stack, which provides the compression and fanning effects outlined previously, but also a further effect of taking weight from a leading napkin to allow that leading napkin to pass under the bottom edge 26 of the shield 20, as will be described further below.

A notch 22 is provided in the shield 20, and which is in communication with the dispensing gap 25, to expose a limited number of folds in the front face of the interfolded napkin stack. The dispensing gap 25 exposes part of a bottom face of the napkin stack, and the notch 22 exposes part, in a sideways direction, of a bottom part of a front face of the napkin stack. While the present embodiment is particularly designed to discourage two-at-a-time dispensing, the notch 22 does allow a user to grasp a limited number of further napkins, and compress them and pull them underneath the bottom edge 26 of the shield 20, as will be explained below.

The shield 20 extends beyond a bottom of the tabs 21 toward the bottom wall 11 to provide a depending skirt portion 24 below the tabs 21. The tabs 21 compress the front face of the stack, while the skirt portion 24 is set back from the tabs 21 to provide a region directly below the tabs 21 in which the front face of the napkin stack is not so compressed. The skirt portion 24 provides a space in which a leading fold of the napkin stack can be brought forward relative to folds in the napkin stack pressed against an inside surface of the tabs 21, where this leading fold is relatively uncompressed to provide a greater freedom of movement.

A use of the dispenser of FIG. 4 will be described with reference to FIGS. 5*a* to 5*c*. A stack of interfolded napkins is loaded into the housing 8 by making use of the openable front cover 2. A bottom face of the fresh stack of napkins is seated against an inside surface of the bottom wall 11 of the housing 8. The napkins are interfolded and positioned so that every other fold is located in a front face of the stack. The napkins may, in an embodiment, comprise first and second panels connected by a fold. The stack of napkins is interfolded so that a leading panel of a succeeding napkin is positioned between leading and trailing panels of a preceding napkin, whereby as the preceding panel is withdrawn from the dispenser, the succeeding napkin is pulled with it.

Figure 5A:
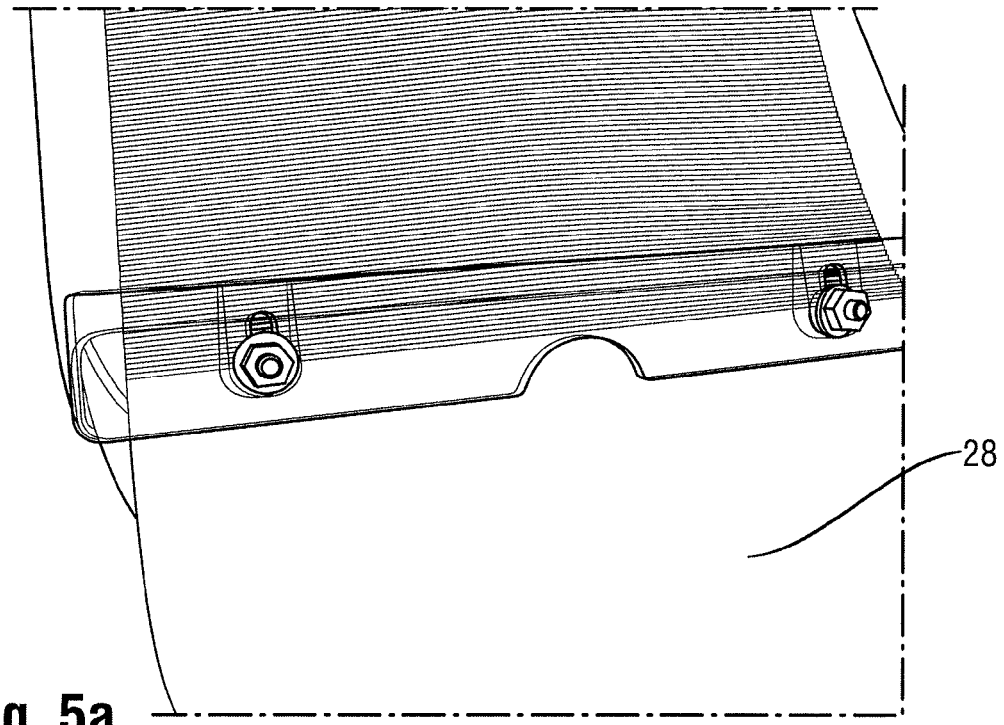
FIGS. 5*a*, 5*b* and 5*c* show sequential steps in dispensing a napkin from the dispenser of FIG. 4. First, a leading flap at the bottom of the stack is picked out through the dispensing gap to create a flap hanging from the dispensing gap, with a fold connecting adjacent panels of the partially hanging napkin positioned against an inside surface of the shield, as shown in FIG. 5*a*. During dispensing, a user is required to push the hanging flap in a direction toward a rear of the dispenser, which causes the fold to move past a bottom edge of the shield and drop through the dispensing gap, as shown in FIG. 5*b*. A user then pinches the fold exposed past the shield and pulls thereon to dispense the leading napkin as well as a napkin sandwiched between adjacent panels of the leading napkin connected by the fold, as shown in FIG. 5*c*. The interfolded configuration of the napkin stack means that the result of dispensing two napkins according to FIG. 5*c* is a leading flap hanging from the dispensing gap as shown in FIG. 5*a*.

The leading panel of the leading napkin, which is seated against an inside surface of the bottom wall 11, is picked through the dispensing gap 25 so as to hang from the dispensing gap 25 as shown in FIG. 5*a*. This causes the fold of the leading napkin to come forward toward an inside surface of the shield 20, particularly to move against an inside surface of the shield 20 at the skirt portion 24 of the shield 20. The leading napkin is able to move forward in part as a result of the weight reducing effect of the tabs 21 compressing the front face of the stack of napkins and in part because of the space provided below the tabs 21 at the skirt portion 24 of the shield 20. In this configuration, the fold of the leading panel tends to point more upwardly than outwardly toward the user, which reduces the accessibility of the fold.

Figure 5B:
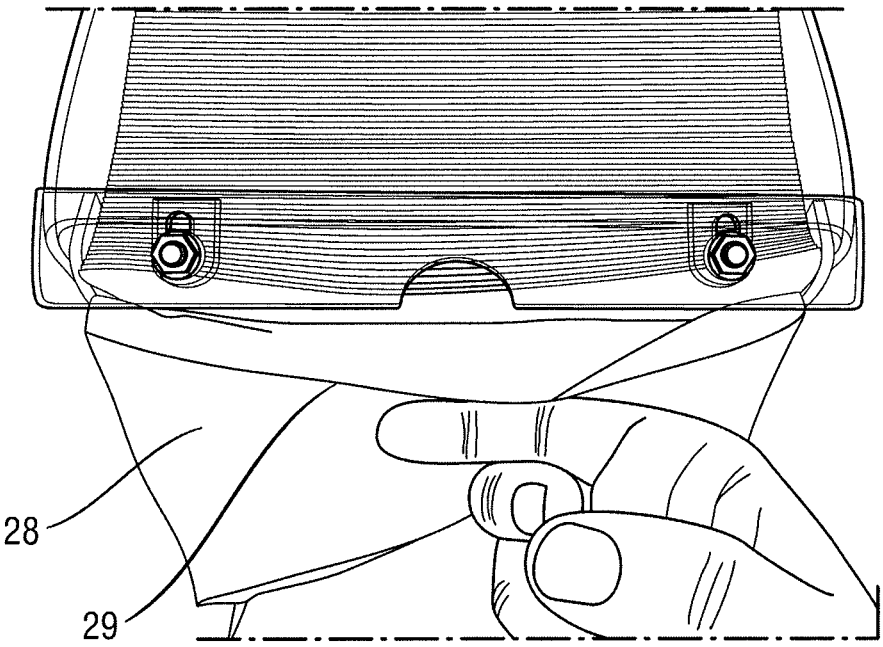
Figure 5C:
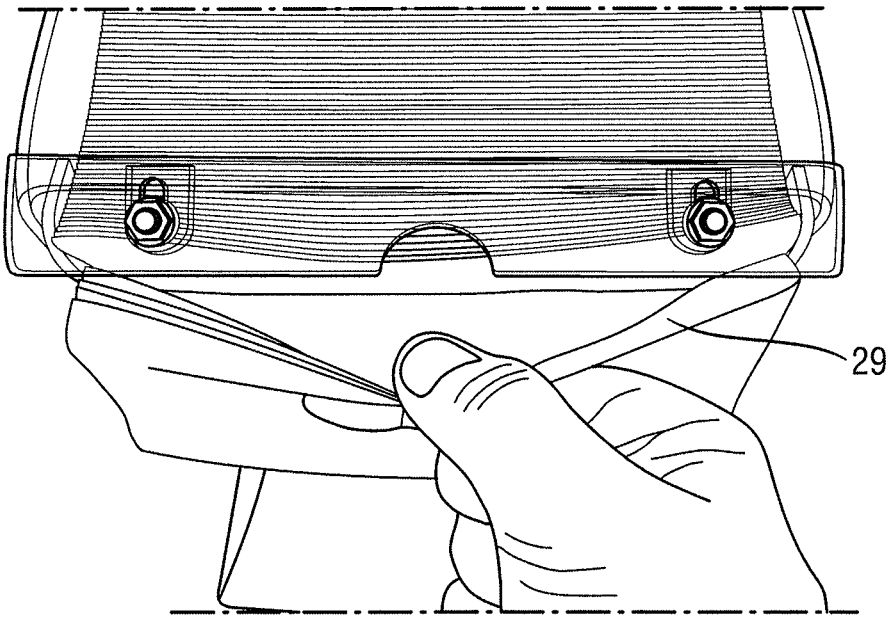

The next step in the dispensing process is to push the hanging flap 28, which is hanging from the dispensing gap 25, rearwardly, as shown in FIG. 5*b*. This drags the leading fold 29 under the bottom edge 26 of the shield 20 to expose that leading fold 29 for grasping by a user, as shown in FIG. 5*b*. Subsequently, the user grasps the leading fold 29 and pulls outwardly as usual in order to dispense the leading napkin and a succeeding napkin, wherein the leading panel of the succeeding napkin is pinched between the leading and trailing panels of the leading napkin. The trailing panel of the succeeding napkin pulls a leading panel of a subsequently succeeding napkin through the dispensing gap 25 so as to hang through the dispensing gap and to provide a further hanging flap 28 as shown in FIG. 5*a*.

This dispensing mechanism and method also promotes two-at-a-time napkin dispensing in a way that ensures ease of dispensing. At the position shown in FIG. 5*b*, the user may, if the user wishes, grasp one or two further napkin folds at the notch 22 in the shield 20 and pull them under a bottom edge 26 of the shield 20. Although dispensing such further napkins can be done, it is more difficult because of the presence of the shield 20, thereby encouraging a more economical use of napkins.

Referring back to FIG. 4, the shield 20 and the tabs 21 can be retrofitted to the conventional dispenser 1 of FIG. 1. More specifically, the tabs 21 can be adhered to an inside surface of the front wall 9 so as to protrude beyond a bottom edge 10 of the front wall 9. The tabs 21 are pre-bored for receipt of the bolts 23. The shield can be supplied as a separate part that is placed in partial overlap with the front wall 9 and positioned so that the bottom edge 26 is aligned with the bottom wall 11. Bolts can be threaded through holes in the tabs 21 and through slots 27 in the shield 20 and secured in this position with nuts 30. The slots 27 are vertically extending so as to allow the shield 20 to be moved closer to or away from the bottom wall 11 to fine tune the alignment between the bottom edge 26 of the shield 20 and the bottom wall 11. This allows the dispensing process described above with respect to FIGS. 5*a* to 5*c* to be successfully implemented by trial and error for the shield position.

The adjustability of the position of the shield 20 provides a third embodiment of the present invention. The adjustability may be increased beyond fine tuning using longer slots 27 so that the shield 20 may be moved into positions not aligning the bottom edge 26 of the shield 20 with the bottom wall 11, thereby providing an unblocked dispensing path in a lower portion of the dispensing opening 7. Also, the shield 20 can be removed by removing the nuts 30 and the bolts 23, which allows the configuration shown in FIG. 4 to be reverted to a configuration as shown in FIGS. 2 and 3. Yet further, the tabs 21 may be removable so that the configuration of FIG. 4 can be reverted to the conventional dispensing opening 7 shown in FIG. 1. This provides great flexibility in customizing the dispensing opening so as to suit particular applications.

Alternatively, the shield 20 should be formed as an integral part with the front wall 9, which sacrifices the adjustability feature, but allows alignment between the bottom edge 26 of the shield 20 to be secured by the manufacturer, for, e.g., a two-at-a-time dispensing application.

In a further alternative to the shown embodiments, the tabs 15 of FIGS. 2 and 3 could be mounted to the front wall 9 in a removable and/or vertically adjustable manner so that the degree of freedom provided by the tabs 15 with respect to dispensing napkins from the dispensing opening 7 can be adjusted and/or restriction of the dispensing opening 7 can be removed entirely.

The stack griping tabs 21 of FIGS. 4 and 5 of the shown embodiments may be provided in other forms. Although the specific form provides a fanning effect at the notch 22, an important effect of the tabs 21 is to engage the front face of the stack to take some of the weight off a leading napkin in the stack and to allow the leading napkin to move forward relative to the compressed part of the stack. This could be achieved with more than the shown number of tabs 21, or with a continuous stack engaging member extending from one side of the dispensing opening to the other, for example.

Other modifications to the specific embodiments shown will be envisageable by the skilled person that fall within the scope of the core concepts of the present invention defined in the claims. Such alternative implementations are within the scope of the present invention.

The invention claimed is:

1. A gravity feed dispenser comprising a housing for containing a stack of napkins, the housing comprising a bottom wall upon which a bottom face of the stack is to be seated and a front wall for at least partly covering a front face of the stack, the dispenser including a dispensing opening for exposing a bottom part of the front face of the stack, an adjustable restriction member that is adjustable between positions in which the dispensing opening is more restricted and less restricted in a direction along the front wall toward the bottom wall, and a fastening mechanism for attaching the adjustable restriction member, wherein the adjustable restriction member is attached to the front wall by the fastening mechanism, the fastening mechanism including two tabs protruding into the dispensing opening in a downward direction toward the bottom wall allowing the position of the adjustable restriction member relative to the front wall to be adjusted, the adjustable restriction member adjustably attaches to each of the two tabs by fasteners.

2. The dispenser of claim 1, wherein the adjustable restriction member is provided in the form of a shield attached to the front wall, the shield extending from one side of the dispensing opening to an opposed side of the dispensing opening.

3. The dispenser of claim 1, wherein the adjustable restriction member is also removable so as to completely open the dispensing opening.

4. The dispenser of claim 1, wherein each tab includes at least one stack engagement member protruding relative to a bottom edge of the front wall for engaging and gripping a bottom part of the front face of the stack, wherein the restriction member is mounted to the front wall via the tab.

5. The dispenser of claim 4, wherein the restriction member extends beyond the stack engagement member to provide a skirt portion extending toward the bottom wall.

6. The dispenser of claim 4, wherein the stack engagement member protrudes relative to an inside surface of the front wall so as to compress the front face of the stack.

7. The dispenser of claim 4, wherein the tabs are disposed on opposed sides of the dispensing opening, yet inset from side ends of the dispensing opening and providing mounting locations for mounting the restriction member to the front wall via the tabs.

8. The dispenser of claim 1, wherein the two tabs each include a longitudinal slot that engage with corresponding bolts that are attached to the restriction member.

* * * * *